US006666060B2

(12) United States Patent
Knaapi et al.

(10) Patent No.: US 6,666,060 B2
(45) Date of Patent: Dec. 23, 2003

(54) ROLLER HEAD FOR A PLANETARY ROLLING MILL

(75) Inventors: Heikki Knaapi, Virrat (FI); Harri Luotola, Luvia (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/168,186

(22) PCT Filed: Dec. 20, 2000

(86) PCT No.: PCT/FI00/01124

§ 371 (c)(1),
(2), (4) Date: Jun. 17, 2002

(87) PCT Pub. No.: WO01/45872

PCT Pub. Date: Jun. 28, 2001

(65) Prior Publication Data

US 2002/0189311 A1 Dec. 19, 2002

(30) Foreign Application Priority Data

Dec. 21, 1999 (FI) ..... 19992740

(51) Int. Cl.[7] ..... B21D 3/00
(52) U.S. Cl. ..... 72/78
(58) Field of Search ..... 72/77, 78, 96, 72/121, 208, 248

(56) References Cited

U.S. PATENT DOCUMENTS 3,718,020 A 2/1973 Leitner
3,735,617 A * 5/1973 Bretschneider ..... 72/78
4,154,076 A * 5/1979 Tuschy et al. ..... 72/69
4,587,820 A * 5/1986 Bohmer ..... 72/78

FOREIGN PATENT DOCUMENTS

| | | | |
|---|---|---|---|
| DE | 2748770 | 5/1979 | |
| DE | 3125682 | 4/1982 | |
| DE | 3531529 | 3/1987 | |
| DE | 19711257 | 9/1998 | |
| JP | 5-285502 | * 11/1993 | ..... 72/78 |
| JP | 8-257609 | * 10/1996 | ..... 72/78 |

* cited by examiner

*Primary Examiner*—Ed Tolan
(74) *Attorney, Agent, or Firm*—Smith-Hill and Bedell

(57) ABSTRACT

A roller head for a planetary rolling arrangement, said roller head comprising a housing, inside which housing there is rotatably arranged a hollow outer axis and means for rotating said outer axis, as well as inside said outer axis, in a manner that transmits the rotary motion thereof, a center axis which is movable in the axial direction and can be locked in the axial direction, said center axis being provided with a roller. The roller head is characterized by an adjusting axis which is rotatably arranged at the end of the outer axis that is located on the opposite side with respect to the roller and is essentially locked in the axial direction said adjusting axis comprising a counterpart for the threaded section provided in the center axis, and said adjusting axis also including a locking member, which in the locking position forms a friction coupling at least between the adjusting axis and the outer axis.

11 Claims, 2 Drawing Sheets

ROLLER HEAD FOR A PLANETARY ROLLING MILL

The present invention relates to a roller head.

Roller heads according to the object of the invention are used in planetary rolling arrangements, where the employed rolling members are mainly conical rollers. Typical prior art roller heads are introduced among others in the following patent publications: U.S. Pat. Nos. 3,718,020, 3,735,617 and 4,587,820. In certain practical applications of the roller heads according to the present invention, it is very important that the roller can be adjusted accurately in the axial direction. In known roller adjusting methods, a drawback is that said methods are very complicated, and/or that the axial adjustment of the roller is inaccurate owing to the employed coupling member arrangements of the adjusting apparatus. Prior art solutions have mainly utilized cogged coupling members for coupling the adjusting axis. Owing to the coupling arrangements of known solutions, the axial adjustment has become stepped. This has lead to a situation where the minimum quantity of the axially directed motional shift has been dependent on the cogging of the coupling member. Moreover, in prior art solutions, it has been troublesome to accurately measure the adjustment to be performed.

The object of the present invention is to achieve a completely new type of arrangement for enabling an advanced and more accurate method for performing the axial adjustment of a roller head. Another object of the invention is to achieve a roller head that enables the measurement of the axial adjustment in an easy and accurate manner.

The invention is characterized by what is stated in the accompanying claims.

The roller head according to the invention has several remarkable advantages. The adjusting arrangement according to the invention enables an extremely accurate and stepless axial adjustment. When applying a stepless locking of the adjusting shaft, there is achieved a remarkably higher axial distance and centering accuracy for the rollers than in the prior art arrangements. By employing an expansible sleeve member as the locking member, there is achieved an extremely feasible solution for a locking member. By employing a pressure-operated sleeve member and particularly by employing a liquid as the pressure medium, said liquid being for instance hydraulic oil, there is achieved a suitable arrangement to be used in connection with the roller head. This solution enables a situation where the locking member constitutes a uniform piece with the adjusting member, or a situation where the locking member is a separate sleeve member between the adjusting shaft and the outer shaft.

Figure 1:
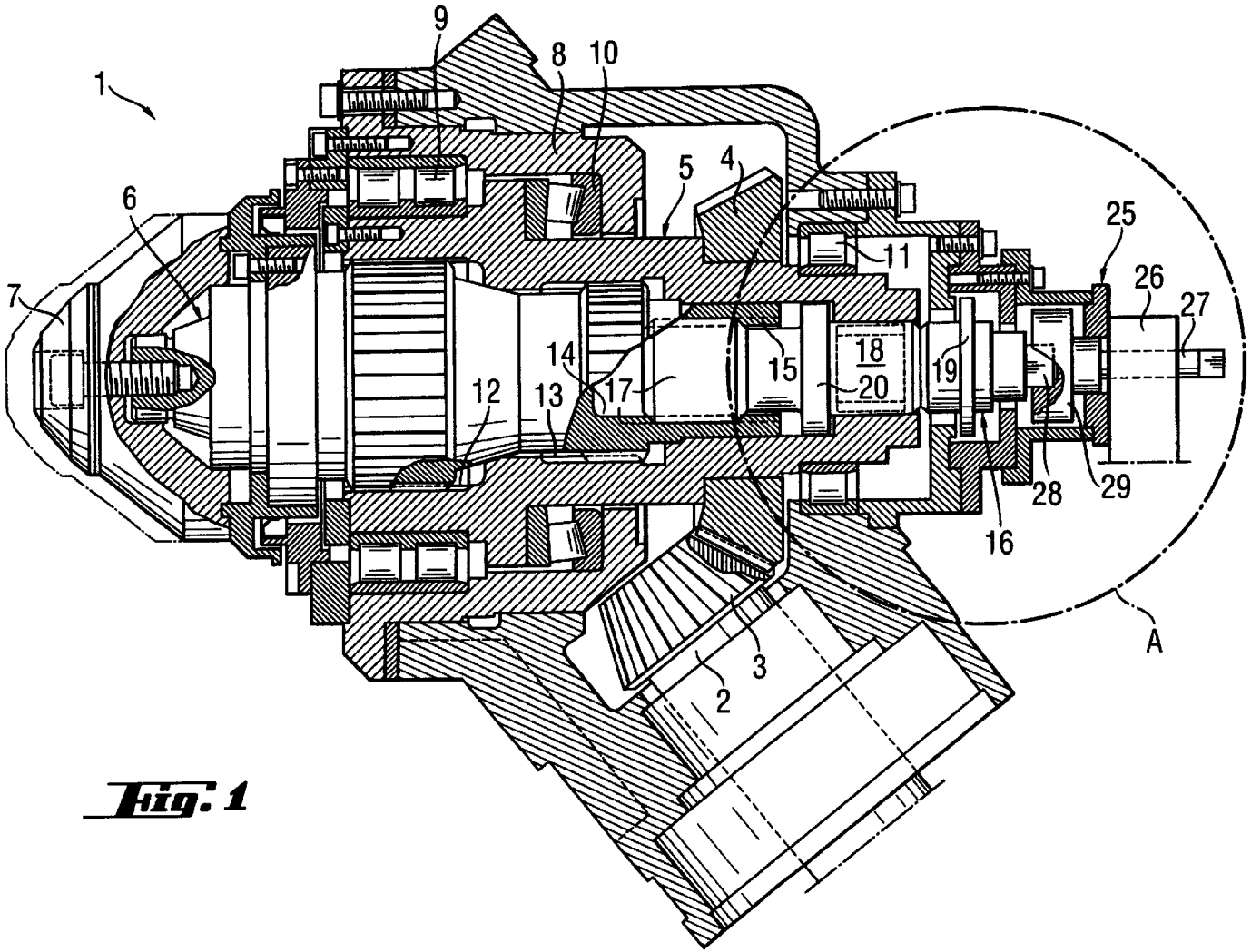
Figure 2:
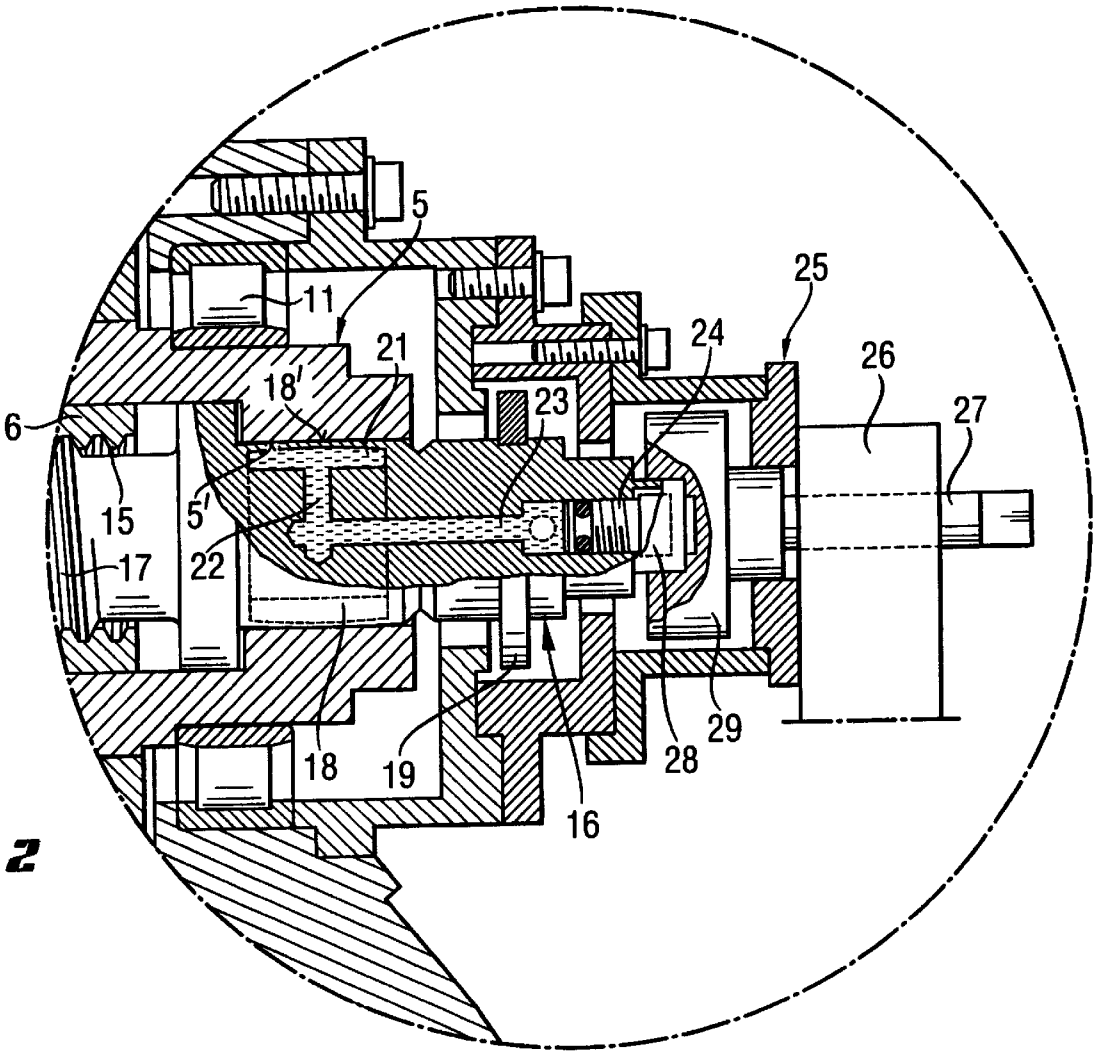

The invention is explained in more detail below, with reference to the appended drawings, where FIG. 1 illustrates a cross-section of a roller head according to the invention, and FIG. 2 illustrates an enlarged detail A of FIG. 1.

The roller head illustrated in the drawings is a roller head used in the so-called PSW rolling mill (Planeten Schr ägwalzwerk, planetary skew-rolling mill). Typically a PSW rolling mill includes three roller heads. The roller head 1 is arranged turnably in the rotor (not illustrated).

The roller head 1 according to the invention comprises a housing 8, inside which housing there is rotatably arranged a hollow outer shaft 5 and means 2, 3, 4 for rotating said outer shaft, as well as a center or inner shaft 6 arranged inside said outer shaft, in a manner that transmits the rotary motion of said outer shaft; said center shaft 6 is movable in the axial direction and lockable in the axial direction, and it is also provided with a roller 7. In the operating shaft 2 of the roller head, there is arranged a drive wheel 3, the rotary motion whereof is transmitted by means of a counterwheel 4 to the hollow outer shaft 5 of the roller head. The outer shaft 5 is arranged rotatably inside the housing 8 of the roller head 1 by intermediation of bearing members 9, 10, 11. The outer shaft 5 of the roller head is rotatably arranged in the roller head housing, at least by two radial-thrust bearings 9, 11, and by an axial bearing 10 provided therebetween. Inside the outer shaft 5, there is arranged a center shaft 6 movably in the axial direction. On the inner surface of the outer shaft 5, there are typically formed for example cogged coupling members 12, 13, in which case in the center shaft 6, there are arranged counterparts that prevent the center shaft 6 from rotating with respect to the outer shaft 5, but allow the center shaft to move in the axial direction. The roller 7 is arranged in the center shaft 6. The roller head is characterized by an adjusting shaft 16, which is arranged rotatably at that head of the outer shaft 5 that is located at the opposite end with respect to the roller 7, said adjusting shaft being essentially locked in the axial direction and comprising a counterpart 17 for the threaded section 15 provided in the center shaft 6; said adjusting shaft 16 includes a locking member 18, which in the locking position forms a friction coupling at least between the adjusting shaft 16 and the outer shaft 5. At that end of the center shaft 6 that is located on the opposite side with respect to the roller 7, there is arranged a bore 14 with threadings 15 made in the side wall thereof. At that end of the roller head that is on the opposite side with respect to the roller 7, there is arranged an adjusting shaft 16, comprising a counterpart 17 for the threaded section 15 of the center shaft 6. The position of the center shaft 6 in the axial direction can be adjusted by turning the adjusting shaft 16. As a result, the position of the center shaft 6 is changed by a distance determined by the thread of the threaded section and the counterpart, depending on the amount of the rotary motion of the adjusting shaft. Typically the threads of the threaded section and the counterpart are extremely precise, for instance so-called trapezoidal threads. Typically the threaded section 15 of the center shaft is arranged in a bore 14 made in the center shaft, in which case the counterpart 17 of the adjusting ante shaft is a screw member. The adjusting shaft 16 comprises a locking member, such as a sleeve member 18, whereby the adjusting shaft can be steplessly locked in the outer shaft 5. The locking member 18 is typically an expansible, pressure-operated sleeve member. In a preferred embodiment, the locking member 18 is a hydraulically operated sleeve member. In the embodiment according to the drawings, the locking member 18 constitutes a uniform piece with the adjusting shaft 16. The locking member can also be a separate sleeve member located between the outer shaft 5 and the adjusting shaft 16. By means of the sleeve member 18, for instance the winding of the adjusting shaft is prevented, and thus also the center shaft 6 is locked in the axially adjusted position. Typically the adjusting shaft 16 comprises members, such as shoulders 19, 20, in order to prevent it from shifting in the axial direction, at least during the adjusting process.

FIG. 2 shows part of the roller head in cross-section. FIG. 2 also shows a typical embodiment of the structure of the locking member 18. The locking member illustrated in the drawing is a so-called hydraulically operated sleeve member. There is arranged a fluid channel system 21, 22, 23 with some hydraulic fluid provided therein. When the liquid pressure in the channel system is raised, the sleeve 18 is at least partly expanded in the radial direction and attached, at the outer surface 18', to the countersurface, which in the case according to the invention is the typically cylindrical surface 5' located in the bore of the outer shaft 5. In the embodiment illustrated in the drawings, in the adjusting shaft 16 there is formed a liquid channel 23, provided with an adjusting screw 24, and by turning said screw the liquid pressure is raised or lowered in the channel system 21, 22, 23 of the sleeve member. In the arrangement according to the invention, the sleeve member 18 can form part of the adjusting shaft 16, in which case it in the fastening position radially affects the outer shaft 5 located outside said sleeve member, or it can be a separate sleeve member, in which case the sleeve member 18, by increasing pressure, radially affects the adjusting shaft 16 located inside it, as well as the outer shaft 5 located outside it.

The invention is operated so that the adjusting shaft 16 is locked, while the rolling mill center shaft 6 is adjusted at a desired point, to the outer shaft 5 by means of the locking member is, most suitably by a friction coupling, in which case also the center shaft 6 is locked in the axial direction. In the case illustrated in FIG. 2, the expansive sleeve 18 serving as the locking member is pressurized by tightening the adjusting screw 24, so that the sleeve is expanded and forms a friction coupling. When the center shaft should be adjusted in the axial direction, the adjusting screw 24 is screwed open, in which case the sleeve 18 is contracted and the friction coupling is released, and the adjusting shaft 16 can again be turned. The axial motion of the rolling will center shaft 6 can be created and measured extremely accurately by providing, for the duration of the adjusting process, an installation device 25 coupled to a measuring device 26. The installation device includes a torsion shaft 27 comprising a counterpart 29 for the driver 28 of the adjusting shaft 16. The amount of the axial motion of the center shaft is obtained when the size of the rotary motion of the adjusting is measured. Advantageously the measuring device 26 is arranged to directly indicate the amount of the axial motion at a typical accuracy of for instance 0.01 mm.

By means of the roller head according to the invention, the axial adjustment is carried out more accurately than in the prior art. By employing an installation device provided with a measuring device, the adjusting process is carried out quickly and precisely.

What is claimed is:

1. A roller head for a planetary rolling arrangement, comprising:

a housing, a hollow outer shaft inside the housing, a drive means for rotating the outer shaft relative to the housing, an inner shaft inside the outer shaft, the inner shaft having a first end for attachment of a roller and also having a second end, the inner shaft having a threaded portion at its second end, a coupling means that couples the outer shaft to the inner shaft in a manner for transmitting rotational movement of the outer shaft to the inner shaft while permitting axial movement of the inner shaft relative to the outer shaft, an adjusting shaft extending partially within the outer shaft and having a threaded portion in threaded engagement with the threaded portion of the inner shaft, a means for limiting axial movement of the adjusting shaft relative to the outer shaft while permitting rotational movement of the adjusting shaft relative to the outer shaft, and a locking means for releasably locking the adjusting shaft against rotational movement relative to the outer shaft by frictional engagement with the outer shaft.

2. A roller head according to claim 1, wherein the locking member is an expansible, pressure-operated member.

3. A roller head according to claim 1, wherein the locking means comprises a hydraulically operated sleeve member.

4. A roller head according to claim 1, wherein the locking means is integral with the adjusting shaft.

5. A roller head according to claim 1, wherein the locking means is a separate sleeve member between the outer shaft and the adjusting shaft.

6. A roller head according to claim 1, wherein the threaded portion of the inner shaft is a portion that defines an internally threaded axial bore at the second end of the inner shaft and the threaded portion of the adjusting shaft is a length segment of the adjusting shaft that is externally threaded and is in threaded engagement with the internally threaded axial bore.

7. A roller head according to claim 1, comprising an installation device for engaging the adjusting shaft and turning the adjusting shaft relative to the inner and outer shafts, in order to effect axial movement of the inner shaft relative to the outer shaft.

8. A roller head according to claim 7, herein the installation device comprises a measuring device for measuring rotational movement of the adjusting shaft.

9. A roller head according to claim 1, wherein the outer shaft is supported in the housing by first and second radial-thrust bearing means and by an axial bearing between the first and second radial-thrust bearings.

10. A roller head according to claim 1, wherein the outer shaft has an end portion defining a passage through which the adjusting shaft extends, the passage being bounded by an inner wall of the outer shaft, and the locking means comprises a means defining a cavity in the adjusting shaft, the cavity having a deflectable outer wall, and a means for pressurizing the cavity, whereby the deflectable wall is forced into contact with the inner wall of the outer shaft.

11. A roller head according to claim 1, wherein the outer shaft has an end portion defining a passage through which the adjusting shaft extends, the passage having a first segment containing the threaded portion of the inner shaft and a second segment of smaller cross-sectional area than the first segment and farther from the first end of the inner shaft than from the second end of the inner shaft, the outer shaft includes an abutment portion between the first and second passages, and the means for limiting axial movement of the adjusting shaft includes a shoulder portion of the adjusting shaft disposed within the first passage of the outer shaft.

* * * * *